US010315814B2

(12) United States Patent
Truskett et al.

(10) Patent No.: US 10,315,814 B2
(45) Date of Patent: Jun. 11, 2019

(54) TRANSFER CAP

(71) Applicant: Canon Kabushiki Kaisha, Tokyo (JP)

(72) Inventors: Van Nguyen Truskett, Austin, TX (US); Colleen Lyons, Austin, TX (US); Matthew C. Traub, Austin, TX (US); Whitney Longsine, Austin, TX (US); Tyler Mann, Austin, TX (US); Steven C. Shackleton, Austin, TX (US)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 15/669,472

(22) Filed: Aug. 4, 2017

(65) Prior Publication Data

US 2019/0039792 A1 Feb. 7, 2019

(51) Int. Cl.

| | |
|---|---|
| ***B67C 3/22*** | (2006.01) |
| ***B65D 51/16*** | (2006.01) |
| ***B67C 9/00*** | (2006.01) |
| ***B67C 7/00*** | (2006.01) |

(52) U.S. Cl.

CPC ..... *B65D 51/1644* (2013.01); *B65D 51/1672* (2013.01); *B67C 3/22* (2013.01); *B67C 7/00* (2013.01); *B67C 9/00* (2013.01)

(58) Field of Classification Search

CPC .. B65D 51/1644; B65D 51/1672; B67C 3/22; B67C 7/00; B67C 9/00

USPC ..... 222/188, 189.09, 544

See application file for complete search history.

(56) References Cited

U.S. PATENT DOCUMENTS

| | | | | | |
|---|---|---|---|---|---|
| 232,170 | A * | 9/1880 | Brady | B65D 51/1644 | 215/311 |
| 664,898 | A * | 1/1901 | Safford | A47G 19/14 | 137/533.23 |
| 1,181,804 | A * | 5/1916 | Simpson | B05B 11/0021 | 215/308 |
| 2,500,199 | A * | 3/1950 | Nesset | A61M 5/162 | 137/559 |
| 2,812,117 | A * | 11/1957 | Butkus | A61J 1/1487 | 141/301 |
| 2,949,129 | A * | 8/1960 | Roehrig | B65D 51/1644 | 137/493.8 |
| 3,419,193 | A * | 12/1968 | Stewart | F42D 1/10 | 222/183 |
| 3,504,822 | A * | 4/1970 | Saloski | B65D 7/22 | 137/860 |
| 4,187,390 | A * | 2/1980 | Gore | B01D 71/36 | 174/102 R |
| 4,643,825 | A * | 2/1987 | Weslowski | B65D 51/1683 | 210/188 |
| 4,660,714 | A * | 4/1987 | Suzuki | B65D 51/1644 | 137/79 |
| 5,165,578 | A * | 11/1992 | Laible | B65D 51/1644 | 137/859 |

(Continued)

FOREIGN PATENT DOCUMENTS

| | | |
|---|---|---|
| JP | 2000-142772 A | 5/2000 |
| JP | 2008-230691 A | 10/2008 |

*Primary Examiner* — Patrick M. Buechner
*Assistant Examiner* — Michael J. Melaragno
(74) *Attorney, Agent, or Firm* — Daniel Ratoff

(57) ABSTRACT

A cap, a method of using a cap, and a system for using the cap. The cap is capable of being fitted to a bottle. The cap includes a transfer port; and a vent port. The vent port includes a membrane and a valve.

20 Claims, 5 Drawing Sheets

(56) References Cited

U.S. PATENT DOCUMENTS 5,462,586 A * 10/1995 Sugiyama ..... B01D 39/083 96/13
5,466,509 A * 11/1995 Kowligi ..... B29C 44/5627 428/141
5,526,956 A * 6/1996 Osgar ..... B65D 85/84 222/105
5,555,238 A * 9/1996 Miyazawa ..... B41J 2/17513 347/86
5,875,921 A * 3/1999 Osgar ..... B67D 7/02 222/1
5,927,559 A * 7/1999 Bommer ..... B05B 11/0016 222/189.09
5,957,328 A * 9/1999 Osgar ..... B67D 7/344 222/1
6,015,068 A * 1/2000 Osgar ..... B01J 4/00 222/105
6,077,356 A * 6/2000 Bouchard ..... B01J 4/008 118/715
6,237,809 B1 * 5/2001 Kawai ..... B67D 7/0261 222/105
6,274,209 B1 * 8/2001 Pagidas ..... B65D 51/1616 206/204
6,460,730 B1 * 10/2002 Liedtke ..... B05B 9/04 222/1
6,648,201 B1 * 11/2003 Marinaro ..... B65D 31/16 222/105
6,676,993 B2 * 1/2004 Klare ..... B01D 67/0088 210/500.36
6,683,126 B2 * 1/2004 Keller ..... C09D 7/69 524/492
6,723,147 B2 * 4/2004 Mashiko ..... B01D 19/0031 156/60
6,879,876 B2 * 4/2005 O'Dougherty ..... B67D 7/0283 700/231
6,942,123 B2 * 9/2005 Wertenberger ..... B65D 77/06 222/94
7,048,136 B2 * 5/2006 Havens ..... B65D 51/1644 206/524.8
7,316,329 B2 * 1/2008 Wertenberger ..... B65D 77/06 222/105
7,516,765 B2 * 4/2009 Hogan ..... A61J 1/1475 141/288
7,664,568 B2 * 2/2010 O'Dougherty ..... B67D 7/0283 700/231
7,702,418 B2 * 4/2010 O'Dougherty ..... B67D 7/0283 700/231
7,927,405 B2 * 4/2011 Bacino ..... B01D 46/54 210/640
8,075,669 B2 * 12/2011 Meindl ..... B01D 53/228 210/500.27
8,100,879 B2 * 1/2012 Blank ..... A61M 5/162 206/216
8,322,571 B2 * 12/2012 Hovinen ..... B01J 4/02 141/21
8,336,734 B2 * 12/2012 Ware ..... B67D 7/0261 137/210
8,371,469 B2 * 2/2013 Takedutsumi ..... B65D 77/06 220/495.03
8,733,598 B2 * 5/2014 Nelson ..... B67D 7/72 222/1
9,108,778 B2 * 8/2015 Wang ..... B65D 51/165
9,120,616 B2 * 9/2015 Ware ..... B67D 7/0261
9,126,749 B2 * 9/2015 Hodges ..... B65D 23/02
9,714,126 B2 * 7/2017 Rye ..... B65D 41/04
2001/0013882 A1 * 8/2001 Niedermeyer ..... B41J 2/175 347/35
2001/0018096 A1 * 8/2001 Klare ..... B01D 67/0088 427/385.5
2002/0092877 A1 * 7/2002 Bowman ..... A45F 3/18 222/490
2003/0004608 A1 * 1/2003 O'Dougherty ..... B67D 7/0283 700/244
2003/0146216 A1 * 8/2003 Torres-White ..... B65D 51/1644 220/203.17
2003/0190272 A1 * 10/2003 Raine ..... A61L 2/0035 422/300
2003/0192920 A1 * 10/2003 Forshey ..... B01F 15/0266 222/504
2004/0084450 A1 * 5/2004 Havens ..... B65D 51/1644 220/203.07
2004/0173636 A1 * 9/2004 Leoncavallo ..... B01L 3/10 222/189.09
2005/0000984 A1 * 1/2005 Tan ..... B67D 1/0009 222/67
2005/0087237 A1 * 4/2005 O'Dougherty ..... B67D 7/0283 137/590
2005/0173668 A1 * 8/2005 Van Zijll Langhout ..... B65D 47/2025 251/351
2006/0012659 A1 * 1/2006 Slomianny ..... B41J 2/175 347/105
2006/0047311 A1 * 3/2006 Lutz ..... A01K 91/00 606/228
2006/0086758 A1 * 4/2006 Coles ..... A45F 3/16 222/211
2006/0186076 A1 * 8/2006 Shiloni ..... B65D 47/06 215/229
2007/0007196 A1 * 1/2007 Komatsu ..... B01D 61/00 210/500.1
2008/0257155 A1 * 10/2008 Bacino ..... B01D 46/54 96/11
2009/0020176 A1 * 1/2009 Hasegawa ..... B67D 7/0261 137/614.05
2009/0049988 A1 * 2/2009 Meindl ..... B01D 53/228 95/285
2009/0179046 A1 * 7/2009 Reichert ..... A45F 3/20 222/95
2009/0230132 A1 * 9/2009 Takedutsumi ..... B65D 77/06 220/495.06
2009/0294450 A1 * 12/2009 Schmalz ..... B60K 15/0406 220/371
2010/0044396 A1 * 2/2010 Skillern ..... A45C 11/20 222/209
2010/0112815 A1 * 5/2010 O'Dougherty ..... B67D 7/0261 438/689
2010/0133292 A1 * 6/2010 Ware ..... B67D 7/0261 222/1
2011/0108575 A1 * 5/2011 Alder ..... A45F 3/04 222/95
2011/0192785 A1 * 8/2011 Pritchard ..... A45F 3/14 210/419
2011/0226806 A1 * 9/2011 O'Dougherty ..... B67D 7/0261 222/1
2011/0240703 A1 * 10/2011 Tobin ..... A45F 3/16 224/576
2013/0161350 A1 * 6/2013 Murrieta ..... A61J 7/0053 222/105
2013/0168410 A1 * 7/2013 Ware ..... B67D 7/0261 222/1
2013/0200104 A1 * 8/2013 Whitehead ..... A45F 3/04 222/146.5
2015/0008219 A1 * 1/2015 Wang ..... F16K 17/19 220/202
2015/0083274 A1 * 3/2015 Kessler ..... B67D 7/0288 141/236
2015/0284236 A1 * 10/2015 O'Dougherty ..... B67D 7/0261 222/1
2015/0360929 A1 * 12/2015 O'Dougherty ..... B67D 7/0261 222/153.09
2015/0375907 A1 * 12/2015 Yamasaki ..... B65D 47/06 222/490
2016/0039659 A1 * 2/2016 Ware ..... B67D 7/0261 222/1
2016/0230905 A1 * 8/2016 Cannon, Jr. ..... B65D 81/2015
2017/0146193 A1 * 5/2017 Aceves ..... F17C 13/001
2018/0127126 A1 * 5/2018 Delage ..... B65B 31/006

* cited by examiner

TRANSFER CAP

BACKGROUND

Field of Art

The present disclosure relates to a transfer cap for a photoresist container.

Description of the Related Art

It is often necessary to ship chemically hazardous fluids such as photoresist. These fluids are typically shipped via a bottle that includes a cap.

Japanese Laid-Open Patent Application 2000-142772 discloses a cap that includes a filter and a pressure release valve which releases pressure from the container if the container becomes over-pressurized. While, Japanese Laid-Open Patent Application 2008-230691 discloses a bottle cap with a tube connected to the bottle cap. Also, US Patent Publication No. 2009/0049988 discloses a container with a gas-permeable vent that has a liquid-tight gas-permeable seal. U.S. Pat. No. 4,643,825 discloses a shipping container that includes a bung with at least two openings. One of the openings of the bung includes a dip tube. Another opening of the bung includes a gas filter. Both openings of the bung are sealed with plugs during shipment of the filled container.

Shipping containers with one or more ports such as a vent port and/or a dispensing port experience multiple issues. For example, a shipping container may experience leaks when opening the vent port on a resist bottle. These leaks may take the form of resist bubbling out the vent port. This can cause problems for shipping hazardous materials. In addition, during transport and shipping overseas, the liquid can flow into one or more of the ports if and when the bottle gets pressurized. If the vent port is uncapped under these conditions, there is no protection against residual fluid flowing or shooting out of the newly opened port. This situation poses a safety hazard especially when handling chemically hazardous fluids.

US Patent Publication No. 2015/0083274 discloses a universal manifold for attaching to various different storage containers. US Patent Publication No. 2001/0013882 discloses bottles that use a puncture seal to deliver the liquid to a main reservoir. US Patent Publication No. 2006/0012659 discloses a bottle that is shipped with a solid cap. Once the bottle is received the solid cap is unscrewed and a cap with a dip tube is attached. These systems can cause problems with purity by generating particles and also allowing contaminates to enter the bottle.

What is needed is a system that is both safe and allows for the purity of the material to be maintained at a high level.

SUMMARY

At least a first embodiment, may be a cap that is capable of being fitted to a bottle. The cap may comprise a transfer port and a vent port. The vent port may include a membrane and a valve.

At least a first embodiment, may be a cap wherein the bottle is configured for storing and transporting liquid.

In an aspect of the first embodiment, the transfer port is a liquid transfer port for draining or filling fluid in and out of the bottle.

In an aspect of the first embodiment, a valve is one of a poppet valve, a check valve, and a manual vent.

In an aspect of the first embodiment, the cap may further comprise a drain port with a connector in the cap allowing the attachment of a drain tube onto the cap extending away from the bottle.

In an aspect of the first embodiment, the membrane may be made of expanded PTFE.

In an aspect of the first embodiment, the transfer port may comprise a dip connector and a transfer connector. The dip connector may allow the attachment of a dip tube onto the cap extending into the bottle. The transfer connector may allow the attachment of a transfer tube onto the cap extending out of the bottle. In an aspect of the first embodiment, the dip connector and the transfer connector may be compression fittings or screw fittings.

In an aspect of the first embodiment, a cap may further comprise an additional port. The additional port may comprise an additional dip connector allowing the attachment of an additional dip tube onto the cap extending into the bottle. In an aspect of the first embodiment, the additional port may further comprise an additional transfer connector allowing the attachment of an additional transfer tube onto the cap extending out of the bottle. In an aspect of the first embodiment, the additional transfer tube may connect the cap to at least one of a reservoir and a valve.

In an aspect of the first embodiment, when the valve is open the vent port may allow gas to pass through the vent port and does not substantially allow liquid to pass through the vent port. In addition, when the valve is closed the vent port may not substantially allow gas or liquid to pass through the vent port.

In an aspect of the first embodiment, the valve may open automatically when internal pressure on the bottle side of the cap is outside an internal pressure range. In an aspect of the first embodiment, a manual vent port may be opened if the valve that opens automatically fails.

In an aspect of the first embodiment, bulk material of the membrane may be made of a material that is compatible with cleaning techniques which are capable of removing ions and small molecules from throughout the membrane to a level of at least 1 ppb.

In an aspect of the first embodiment, the ion leaching of materials used for manufacturing of the cap may provide ion cleanliness levels <1 ppb for elements: Na, Ca, Fe, K, Zn, Al, Mg, Ni, Cr, Cu, Pb, Mn, Li, Sn, Ba, Co, Sr, and Pd.

In an aspect of the first embodiment, materials of the membrane, the valve, a surface of the transfer port, and a surface of the vent port may be made of material that is compatible with cleaning techniques which are capable of removing ions and small molecules from their surfaces to a level of at least 1 ppb.

In an aspect of the first embodiment, one or more of the materials used for fabricating the cap may be selected from: polypropylene; polyethylene; and fluorinated plastics, such as polyvinylidene fluoride; and PTFE.

An aspect of a second embodiment, is a method of using a cap attached to a bottle. The cap may comprise: a transfer port and a vent port that includes a membrane and a valve. The method may comprise: removing one of a cap or a plug from the vent port; opening the vent port with a manual valve; removing one of a cap or a plug from the fluid port; attaching the bottle to a reservoir via a transfer tube; and activating a pump to draw liquid out of the bottle via the transfer tube and into the reservoir.

An aspect of a third embodiment, is a liquid transfer system. The liquid transfer system may comprise: a bottle containing a liquid; a cap attached to the bottle; a reservoir; a transfer tube connecting the reservoir to the transfer port; and a pump to draw liquid out of the bottle via the transfer tube and into the reservoir. The cap may comprise: a transfer port and a vent port that includes a membrane and a valve.

These and other objects, features, and advantages of the present disclosure will become apparent upon reading the following detailed description of exemplary embodiments of the present disclosure, when taken in conjunction with the appended drawings, and provided claims.

BRIEF DESCRIPTION OF DRAWINGS

Further objects, features and advantages of the present disclosure will become apparent from the following detailed description when taken in conjunction with the accompanying figures showing illustrative embodiments of the present disclosure.

Figure 1A:
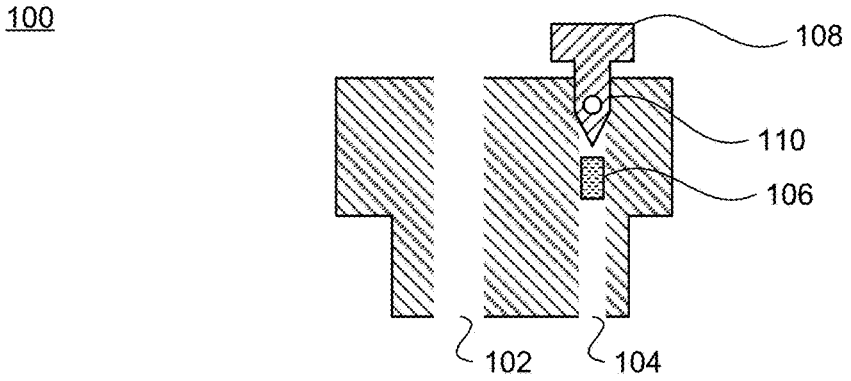
FIGS. 1A-B are illustrations of cross sections of transfer caps.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative exemplary embodiments. It is intended that changes and modifications can be made to the described exemplary embodiments without departing from the true scope and spirit of the subject disclosure as defined by the appended claims.

DETAILED DESCRIPTION

What is needed is a solution that will prevent safety hazards associated with previous caps while maintaining cleanliness requirements and also adding functional features such as a having a built in transfer port in the cap. The environment in which the transfer port is used has a very high cleanliness requirement. The transfer cap is part of a larger system which should not add more than 5 ppb worth of contamination over a year of continuous use. In order to keep defects low it is important that all components and materials used can be cleaned to a high level of cleanliness, which can then be maintained over the life of the product.

First Embodiment

Figure 1B:
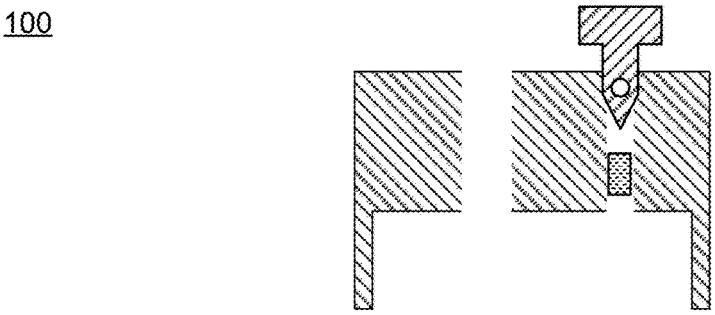

FIGS. 1A-B are illustrations of cross sections of transfer caps. Transfer cap 100 is an example of a first embodiment. The transfer cap 100 includes a transfer port 102 and a vent port 104. The transfer cap 100 illustrated in FIG. 1A includes a top portion that may have a larger diameter than the bottom portion. The transfer port 102 may be a transfer port for draining, filling, and/or sampling fluid in and out of the bottle.

The bottom portion of the transfer cap 100 illustrated in FIG. 1A may include threads which interface with internal threads of a bottle (not shown). The bottom portion of the transfer cap 100 illustrated in FIG. 1B may include threads which interface with external threads of a bottle. In an alternative embodiment, the transfer cap 100 may not include threads but instead includes a snap fitting which interfaces with a lip on the bottle. The bottle may be configured for storing, transporting, and dispensing a fluid such as a photoresist and like liquids.

The transfer cap 100 may include a seat which also interfaces with the bottle. The seat of the transfer cap 100 may be capable of forming a liquid tight seal with the bottle. A gasket may also be used in conjunction with the transfer cap to form the liquid tight seal. In an alternative embodiment, the seat of the transfer cap may be capable of forming a gas tight seal and a liquid tight seal with the bottle.

The vent port 104 of the transfer cap 100 includes a membrane 106 and a valve 108. Because the membrane 106 may pose a cleanliness concern, it may need to be subject to harsh chemicals so that it can meet high cleanliness specifications. The membrane 106 may be made of expanded PTFE. The valve 108 may include a vent opening 110. The valve 108 may be threaded or unthreaded. The valve 108 may be opened by unscrewing or by being raised. The valve 108 may include instead of threads a snap fitting that interfaces with a lip in the vent port 104. The valve 108 may form a substantially gas tight and liquid tight seal when closed. The valve 108 may control the rate at which gas and/or liquid is released when the valve 108 is in an open position. The release rate may be controlled by the size of the vent opening 110.

The membrane 106 is configured to allow gas to pass while not allowing liquid to pass. The pore size of the membrane 106 may be configured to allow some low molecular weight gases (Nitrogen, Oxygen, etc,) to pass.

Figure 2:
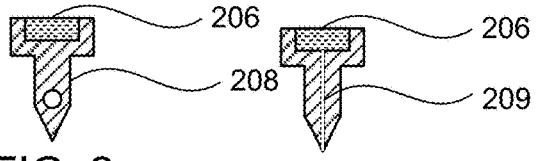
FIG. 2 includes illustrations of cross sections of valves.

The membrane 106 may be placed in the vent port 104 as illustrated in FIGS. 1A-B below the valve 108. In an alternative embodiment, a membrane 206 may be incorporated into a valve 208 as illustrated in FIG. 2. The valve 208 may include a hollow portion 209 that allows gas to pass towards the membrane 206 as illustrated in FIG. 2.

Figure 3:
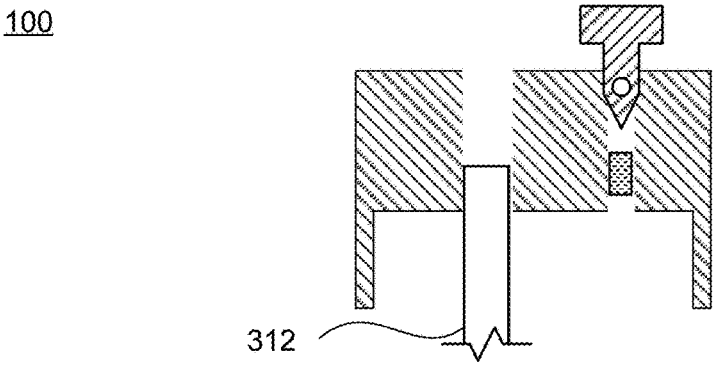
FIG. 3 is an illustration of a cross section of a transfer cap as used in an embodiment.
Figure 4:
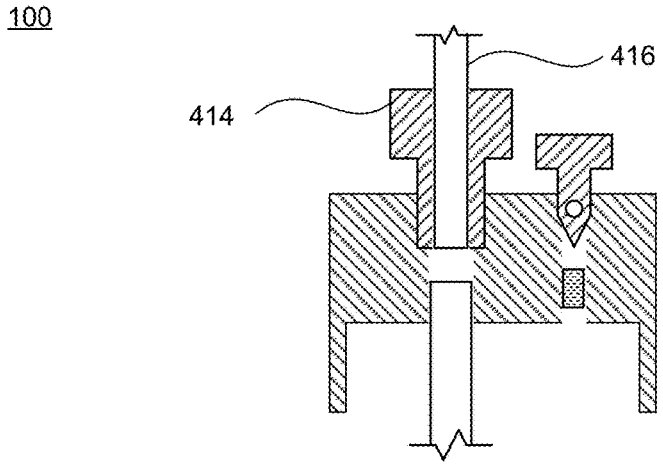
FIG. 4 is an illustration of a cross section of a transfer cap as used in an embodiment.

The transfer port 102 may be configured to accept a dip tube 312 as illustrated in FIG. 3. In one embodiment, the dip tube 312 may be press fitted into the cap 100. In an alternative embodiment, the dip tube may include threads which screw into internal threads which are in the transfer port 102. In another embodiment, the dip tube 312 may include a snap fitting that interfaces with a lip inside the transfer port 102. In a further embodiment, the transfer port 102 extends outward from the cap 100 and into the bottle. The portion of the transfer port 102 that extends into the bottle may include external lips, threads, or other fittings which interface with the dip tube 312. The dip tube 312 may extend the length of the bottle. In an alternative embodiment, the dip tube 312 may be threaded through the entire length of the transfer port as a single continuous tube extending to the bottom of the bottle and having a segment above the transfer cap 100 with connectors that attach to an external system such as a reservoir or a pump.

The transfer port 102 may be configured to accept a compression fitting 414 (or screw fitting). The compression fitting 414 may form a gas tight seal and liquid tight seal with the cap 100. The compression fitting 414 is configured to accept a transfer tube 416 and form a gas tight seal and a liquid tight seal with the transfer tube 416. Alternatively, the transfer tube 416 may be inserted directly into the transfer port 102. In another alternative, the transfer tube 416 and the dip tube 312 may be combined into a single tube.

Figure 5A:
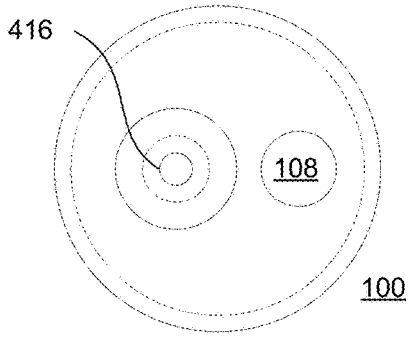
FIGS. 5A-D are illustrations of top down views of different embodiments of the transfer caps.
Figure 5B:
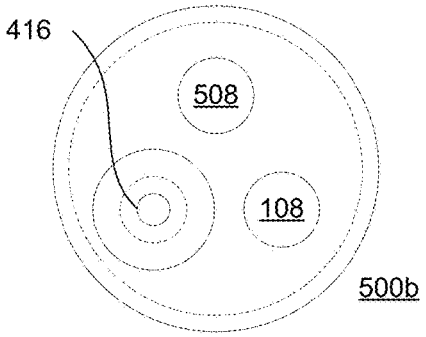
Figure 5C:
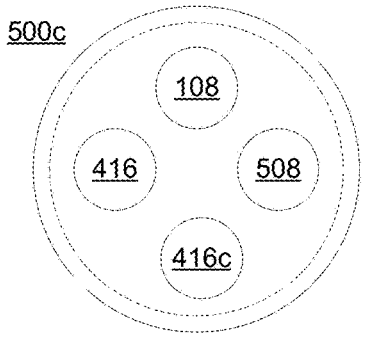
Figure 5D:
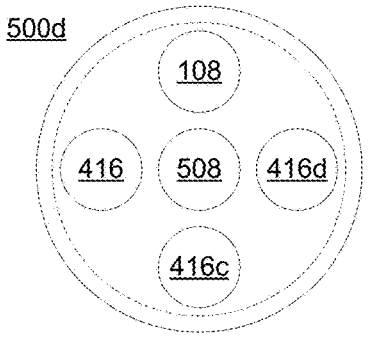

FIG. 5A is a top down view of the cap 100 in which the vent 108 is shown adjacent to the transfer port 416. FIG. 5B is a top down view of a cap 500*b* which is substantially similar to cap 100 except that it includes an additional vent 508. The vent 108 may be a controlled vent port while the vent 508 may be a manual vent override. The vent 108 may include a pressure release valve which opens when the pressure differential is above a threshold such as 0.2 psi or 1 psi or when the internal pressure is outside an internal pressure range. The vent 108 may allow a gas to be released if the container becomes over-pressurized due to outgassing, temperature increases, etc. The vent 108 may also be configured to let gas in to prevent a partial vacuum from exceeding a threshold as the fluid is pumped out of the bottle. FIG. 5C is a top down view of a cap 500*c* which is substantially similar to cap 100 except that it includes an additional vent 508 and an additional transfer port 416*c*. FIG. 5D is a top down view of a cap 500*d* which is substantially similar to cap 100 except that it includes an additional vent 508, an additional transfer port 416*c*, and an additional transfer port 416*d*. The additional transfer ports 416*c* and 416*d* are substantially similar to the transfer port 416. Each of the additional transfer ports 416*c-d* may have separate functions such as: a sample port for testing the liquid in the bottle; a filling port for refilling the bottle; a separate transfer port for transferring fluid to a separate location or at a higher rate. One or more of the additional transfer ports 416*c-d* may be a drain port with a connector allowing an attachment of a drain tube onto the cap extending away from the bottle. In an embodiment, a plurality of dip tubes that extend into the bottle may be connected to a plurality of ports in the cap. In an embodiment, a plurality of transfer tubes that extend from the bottle may be connected to a plurality of ports in the cap.

Figure 6:
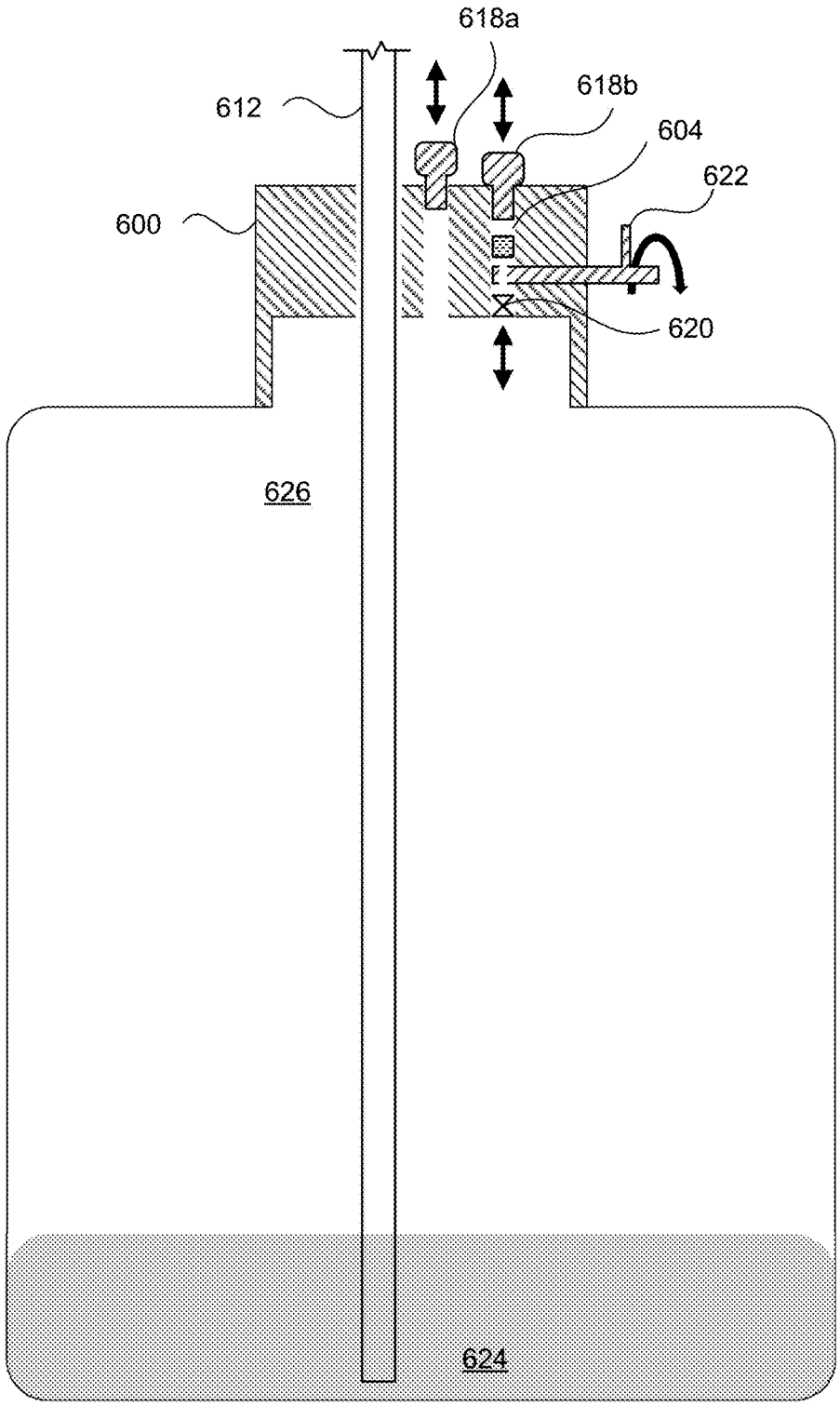
FIG. 6 shows a cross section of a transfer cap as used in combination with a bottle as used in an embodiment.

FIG. 6 is an illustration of a transfer cap 600 used in combination with a bottle 626 containing a liquid 624. A dip tube 612 may be inserted into the transfer cap 600 forming a gas tight and a liquid tight seal with a compression fitting, screw fitting, etc. The transfer cap may include a secondary vent port in which a plug 618*a* is inserted providing a gas tight and a liquid tight seal. When removed the plug 618*a* provides a membrane free secondary vent port to allow additional venting. The transfer cap 600 may include one or both of a dip connector for connecting the dip tube and a transfer connector for connecting a transfer tube.

During shipment, the primary vent port 604 of the transfer cap 600 may be capped with a plug 618*b* as illustrated in FIG. 6. These plugs 618*a-b* or caps may be removed to expose the vent valve and flow pathway. These caps keep the flow paths and ports clean during storage and shipping. The dip tube or dip port may also include a cap or plug. The plug 618*b* may form a gas tight seal and/or a liquid tight seal with the transfer cap 600. A membrane 106 may be included in the primary vent port 604. The primary vent port 604 may include a manual shut off valve 622 which forms a gas tight seal and/or a liquid tight seal with the primary vent port 604 when the valve is closed. When the manual shut off valve 622 is open and plug 618*b* is removed gas may pass through the membrane 106 while liquid does not pass through the membrane 106. The primary vent port 604 may include a pressure release valve 620 when the pressure differential is above a threshold such as 0.2 psi or 1 psi. The pressure release valve 620 may be in addition to or a replacement for the manual shut off valve 622. In an embodiment, the manual shut off valve may be in series or in parallel to the pressure release valve 620 and may be opened if the pressure release valve 620 fails.

The membrane 106 may be a porous material that allows vapor to pass and prevents liquid from escaping. The membrane 106 may made of a frit or membrane material such as: glass; metal; expanded PTFE; PEEK; Polyethylene; Polypropylene, etc. The membrane material is a chemically resistant material which does not react with the material that is intended to be stored in the bottle. The membrane material may also be chemically resistant to cleaning solvents and other materials that are to be used in combination with the bottle. The membrane 106 may have pore size between 50 nm to 500 μm. In an embodiment, the membrane pore size may be between 30 μm to 70 μm. The membrane pore size impacts the desired flow rate for venting and the time required to trigger the vent valve.

The pressure release valve 620 may be triggered to open when there is a partial vacuum and/or over pressurization above a threshold inside the bottle and may be triggered to close at the end of the fluid transfer. The close of the pressure release valve 620 can prevent the dripping of liquid out of the transfer tube when the transfer tube is disconnected from a pump. The pressure release valve 620 may be triggered open when a pressure differential inside the bottle is greater than 0.2 psi or greater than 1 psi for controlled venting.

The transfer cap may include a manual gas release valve in addition to a plug 208 that is built into the transfer cap which the user can open or close to vent gas in a controlled manner. The manual gas release valve may be a captive luer plug or a needle valve.

This transfer cap allows the bottle 626 to vent to the atmosphere while liquid 624 is being pumped out. For example, when a critical vacuum is reached within the bottle 626, the valve 620, which may be a poppet valve or duckbill valve, is triggered to open.

Materials used for the transfer cap and the associated components may meet <1 ppb ion cleanliness and are chemically resistant to material stored under the cap and in the bottle. Chemically resistant in this context is material that does not substantially get swollen, get brittle, oxidize, etc, when exposed to the material stored in the bottle and the environment in which the bottle is used. The ion leaching of materials used for manufacturing of the cap may provide ion cleanliness levels <1 ppb or alternatively <10 ppb for elements: Na, Ca, Fe, K, Zn, Al, Mg, Ni, Cr, Cu, Pb, Mn, Li, Sn, Ba, Co, Sr, and Pd. The materials of the membrane, the valve, a surface of the transfer port, and a surface of the vent port are made of material that is compatible with cleaning techniques which are capable of removing ions and small molecules from the membrane, the valve, a surface of the transfer port, and a surface of the vent port to a level of at least 1 ppb. The bulk material of the membrane may be made of material that is compatible with cleaning techniques which are capable of removing ions and small molecules from throughout the membrane to a level of at least 1 ppb. The materials used for fabricating the cap may be selected from: polypropylene; polyethylene; fluorinated plastics such as polyvinylidene fluoride; and PTFE.

In an embodiment, a transfer tube is connected to a pump pulling on liquid in the tubes and bottle. Initially, the valve 620 is closed and does not open until a target cracking pressure (like 1 psi or lower) is reached. The transfer tube is connected to the pump and continues to pump down the bottle until a low vacuum is achieved which triggers the opening of the valve 620. Then liquid flows out of the bottle and into a reservoir. In an embodiment, a transfer tube may connect the cap to one of a reservoir, a valve, or a pump.

Second Embodiment

Figure 7:
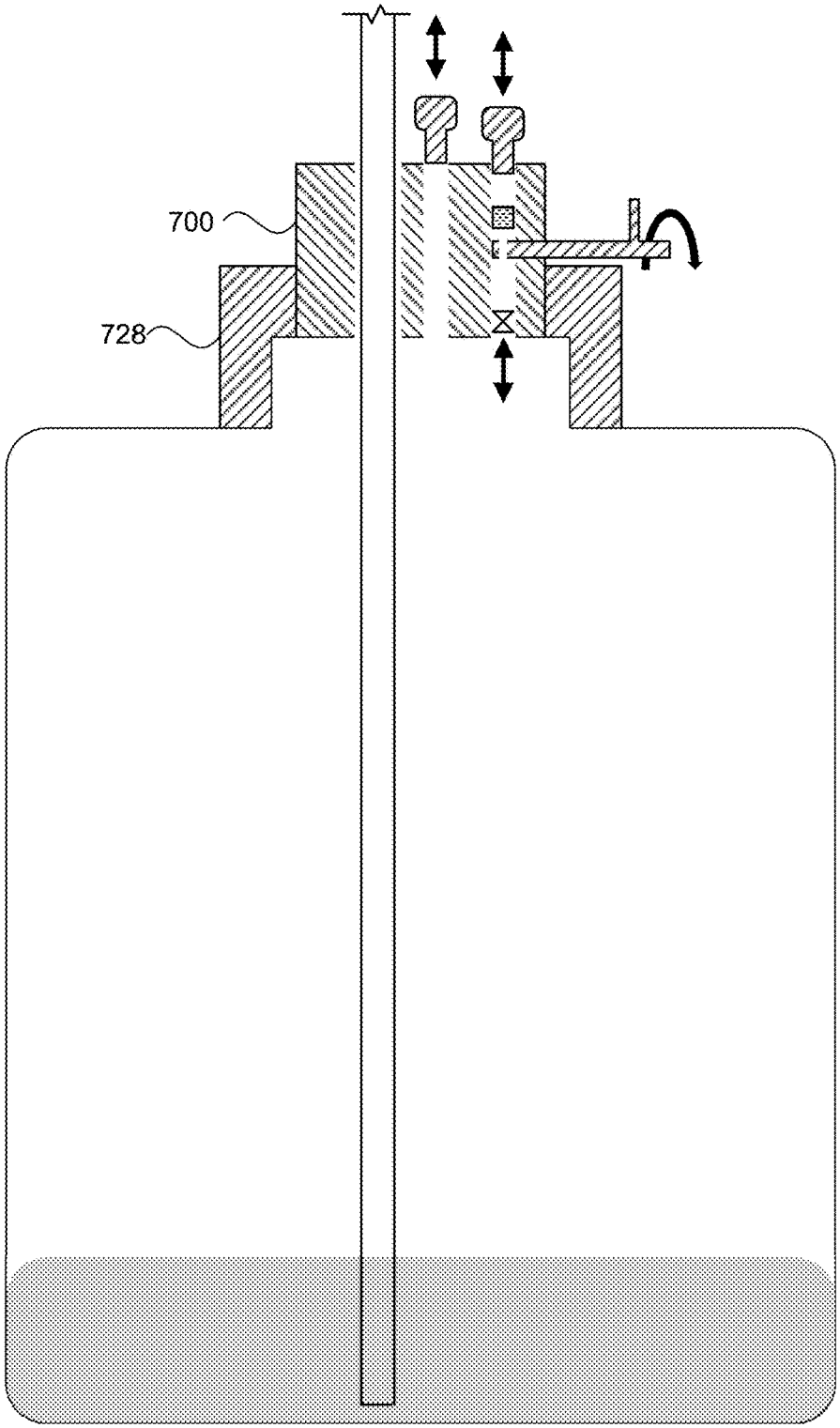
FIG. 7 shows an additional cross section of embodiment as used in combination with a bottle.

An alternative embodiment is a transfer cap insert 700 which is used in combination with a bottle cap 728 as illustrated in FIG. 7. The bottle cap may include a hole or may be modified to include a hole. The transfer cap insert 700 is fitted to make a gas tight and liquid tight seal with the hole in the bottle cap 728. The bottle cap 728 may be a standard bottle cap which works with the bottle 626 which is modified to include a hole in which the transfer cap insert 700 is inserted into.

Methods

A preparation method of using the transfer cap may include preparing a bottle and transfer cap for shipment as illustrated in FIG. 7. The preparation method may include a step of inserting a valve and a membrane into a vent port of the transfer cap. The preparation method may include steps of cleaning the bottle and transfer cap and inserting a clean transfer tube into the transfer cap. The preparation method may include a step of opening a mechanical valve on the vent port if the vent port has a mechanical valve. The preparation method may include a step of attaching the clean transfer cap to the bottle. The preparation method may include a step of filling the bottle through the transfer tube. After the bottle is filled the preparation method may include a step of capping or plugging the transfer tube or transfer port. The vent valve may then be closed and the vent port may be capped or plugged. The bottle is now ready for transport.

Figure 8:
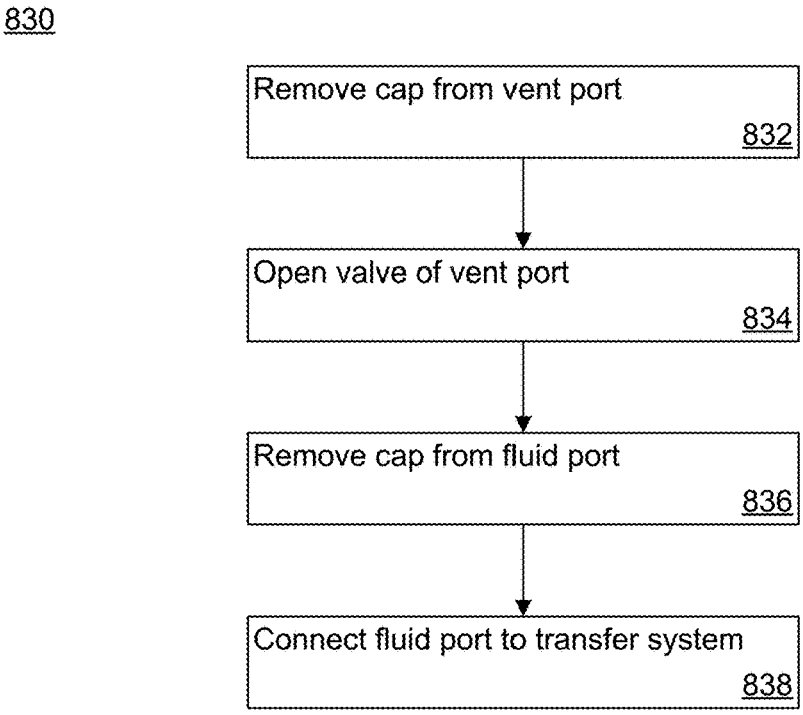
FIG. 8 is an illustration of a method of using the transfer cap.

The transfer cap may be used in a transfer method 830 of inserting the bottle with the transfer cap into a system in which the bottle is used as illustrated in FIG. 8. The transfer cap may include a membrane and a valve. The transfer method may include a step 832 of removing a cap or plug from the vent port. After the vent port is opened, the membrane may be exposed to the ambient environment. If the vent port includes a mechanical valve the mechanical valve may be opened in a step 834, after which a cap or plug may be removed from a transfer tube or a transfer port in a step 836. The transfer tube may then be connected to a reservoir in a step 838 or other part of the transfer system. A pump may be between the reservoir and the transfer tube. A pump may then be activated to draw liquid out of the bottle via the transfer tube and into the reservoir. An automatic valve of the vent port may open automatically when vacuum pressure inside the bottle is greater than a threshold.

System

Figure 9:
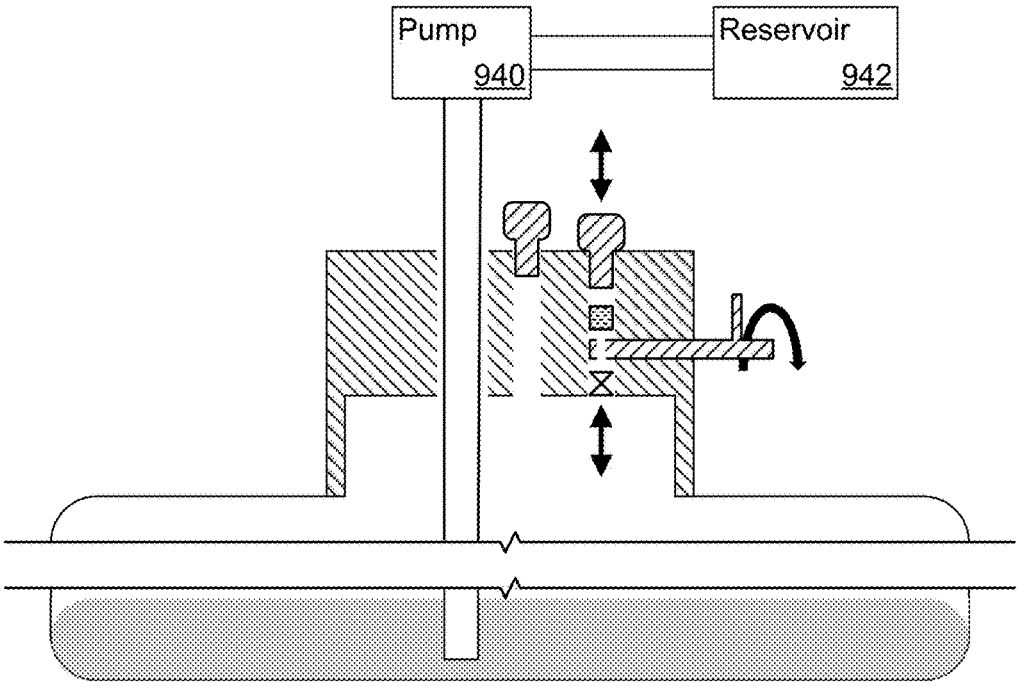
FIG. 9 is an illustration of a system in which an embodiment might be used.

An embodiment may be used in combination with a liquid transfer system as illustrated in FIG. 9. The liquid transfer system includes a bottle containing a liquid substantially similar to the bottle illustrated in FIGS. 6-7. A transfer cap may be attached to the bottle. The transfer cap includes at least a transfer port and a vent port. The vent port includes at least a membrane and a valve.

The liquid transfer system may also include a reservoir 942, a transfer tube, and a pump 940. The pump 940 may draw liquid out of the bottle via the transfer tube and into the reservoir 942. The transfer tube may connect the pump or the reservoir to the transfer port. The pump may be in the reservoir, may be connected to reservoir, or may between the reservoir and the transfer port.

The valve of the vent port may open automatically when vacuum pressure inside the bottle is greater than a threshold.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

While the present disclosure has been described with reference to exemplary embodiments, it is to be understood that the present disclosure is not limited to the disclosed exemplary embodiments. The scope of the following claims is to be accorded the broadest interpretation so as to encompass all such modifications and equivalent structures and functions.

What claimed is:

1. A cap that is capable of being fitted to a bottle, the cap comprising:

a transfer port; and a vent port that includes a membrane and a valve; and wherein an ion leaching of materials used for manufacturing of the cap provide ion cleanliness levels <1 ppb for elements: Zn, Pb, Li, Sn, Ba, Co, Sr, and Pd;

wherein the transfer cap is fitted to the bottle by one of: threads which interface with threads of the bottle; and a snap fitting which interfaces with a lip on the bottle.

2. The cap of claim 1, wherein the bottle is configured for storing and transporting liquid.

3. The cap of claim 1, wherein the transfer port is a liquid transfer port for draining or filling fluid in and out of the bottle.

4. The cap of claim 1, wherein the valve is one of a poppet valve, a check valve, and a manual vent.

5. The cap of claim 1, further comprising a drain port with a connector in the cap allowing the attachment of a drain tube onto the cap extending away from the bottle.

6. The cap of claim 1, wherein the membrane is made of expanded PTFE.

7. The cap of claim 1, wherein the transfer port comprises:

a dip connector allowing the attachment of a dip tube onto the cap extending into the bottle; and a transfer connector allowing the attachment of a transfer tube onto the cap extending out of the bottle.

8. The cap of claim 7, wherein the dip connector and the transfer connector are compression fittings or screw fittings.

9. The cap of claim 1, further comprising an additional port, wherein the additional port comprises:

an additional dip connector allowing the attachment of an additional dip tube onto the cap extending into the bottle.

10. The cap of claim 9, wherein the additional port further comprises:

an additional transfer connector allowing the attachment of an additional transfer tube onto the cap extending out of the bottle.

11. The cap of claim 10, wherein the additional transfer tube connects the cap to at least one of a reservoir and a valve.

12. The cap of claim 1, wherein;

when the valve is open the vent port allows gas to pass through the vent port and does not substantially allow liquid to pass through the vent port, wherein the membrane is disposed so as to prevent liquid from scattering outside through the vent port when opening the valve included in the vent port; and when the valve is closed the vent port does not substantially allow gas or liquid to pass through the vent port.

13. The cap of claim 1, wherein the valve opens automatically when internal pressure on the bottle side of the cap is outside an internal pressure range.

14. The cap of claim 13, further comprising a manual vent port that can be opened if the valve that opens automatically fails.

15. The cap of claim 1, wherein bulk material of the membrane is made of a material that is compatible with cleaning techniques which are capable of removing ions and small molecules from throughout the membrane to a level of at least 1 ppb.

16. The cap of claim 1, wherein the ion leaching of materials used for manufacturing of the cap provide ion cleanliness levels <1 ppb for elements: Na, Ca, Fe, K, Al, Mg, Ni, Cr, Cu, and Mn.

17. The cap of claim 1, wherein materials of the membrane, the valve, a surface of the transfer port, and a surface of the vent port are made of material that is compatible with cleaning techniques which are capable of removing ions and small molecules from their surfaces to a level of at least 1 ppb.

18. The cap of claim 1, wherein one or more of the materials used for fabricating the cap are selected from: polypropylene; polyethylene; and fluorinated plastics, such as polyvinylidene fluoride; and PTFE.

19. A method of using a cap attached to a bottle wherein the cap comprises: a transfer port and a vent port that includes a membrane and a valve, wherein an ion leaching of materials used for manufacturing of the cap provide ion cleanliness levels <1 ppb for elements: Zn, Pb, Li, Sn, Ba, Co, Sr, and Pd, wherein the transfer cap is fitted to the bottle by one of: threads which interface with threads of the bottle; and a snap fitting which interfaces with a lip on the bottle, the method comprising:

removing one of a vent cap or a vent plug from the vent port;

opening the vent port with a manual valve;

removing one of a transfer cap or a transfer plug from the transfer port;

attaching the bottle to a reservoir via a transfer tube; and activating a pump to draw liquid out of the bottle via the transfer tube and into the reservoir.

20. A liquid transfer system comprising:

a bottle containing a liquid;

a cap attached to the bottle wherein the cap comprises:

a transfer port; and a vent port that includes a membrane and a valve;

wherein an ion leaching of materials used for manufacturing of the cap provide ion cleanliness levels <1 ppb for elements: Zn, Pb, Li, Sn, Ba, Co, Sr, and Pd;

wherein the transfer cap is fitted to the bottle by one of: threads which interface with threads of the bottle; and a snap fitting which interfaces with a lip on the bottle;

a reservoir;

a transfer tube connecting the reservoir to the transfer port; and a pump to draw liquid out of the bottle via the transfer tube and into the reservoir.

* * * * *